US005657889A

United States Patent [19]

Guglielmini

[11] Patent Number: 5,657,889

[45] Date of Patent: Aug. 19, 1997

[54] CLOSURE CAP MADE OF MOULDED PLASTICS MATERIAL FOR CLOSING NECKED CONTAINERS

[75] Inventor: Bernard Guglielmini, Crimolois, France

[73] Assignee: Rical (Societe Anonyme), France

[21] Appl. No.: 509,822

[22] Filed: Aug. 1, 1995

[51] Int. Cl.[6] ..... B65D 41/34

[52] U.S. Cl. ..... 215/252

[58] Field of Search ..... 215/252

[56] References Cited

U.S. PATENT DOCUMENTS

| | | | |
|---|---|---|---|
| 4,305,516 | 12/1981 | Perne et al. | 215/252 |
| 4,527,705 | 7/1985 | Prades | 215/252 |
| 4,595,110 | 6/1986 | Herr | 215/252 |
| 5,080,246 | 1/1992 | Hayes | 215/252 |
| 5,129,530 | 7/1992 | Fuchs . | |

FOREIGN PATENT DOCUMENTS

| | | |
|---|---|---|
| 0 117 104 | 8/1984 | European Pat. Off. . |
| 0 560 051 | 9/1993 | European Pat. Off. . |
| WO91/17090 | 11/1991 | WIPO . |

*Primary Examiner*—Joseph M. Moy
*Attorney, Agent, or Firm*—Bacon & Thomas

[57] ABSTRACT

A closure cap made of moulded plastics material for closing necked containers is disclosed. The cap includes a tamper-proof ring formed from a belt and a folded band, the belt having a local overthickness presenting an angular area corresponding to that separating two successive interruptions of the folded band. The invention is more particularly applicable to so-called "pigtail" caps.

4 Claims, 3 Drawing Sheets

CLOSURE CAP MADE OF MOULDED PLASTICS MATERIAL FOR CLOSING NECKED CONTAINERS

BACKGROUND OF THE INVENTION

1. Technical Field of the Invention

The present invention relates to closure caps made of moulded plastics material for closing necked containers and more particularly to closure caps designed to guarantee that the closure that they establish is tamper-proof.

The object of the invention concerns more particularly closure caps made of moulded plastics material of which the guarantee of impregnability is achieved by a ring which extends the base of the skirt of the cap and which is detachable, at least in part, when the container is first opened.

More specifically still, the invention concerns those closure caps which are mounted on the net of a container via helicoidal threads.

2. Description of the Related Art

Tamper-proof closure caps may be classified in two categories.

The first category corresponds to caps provided with a tamper-proof ring which is automatically detached from the base of the skirt upon opening by unscrewing.

In that case, the tamper-proof ring remains in place on the neck of the bottle or container and marks, by its presence, the opening of the cap and consequently the fact that the closure that it effects has been violated.

Such closure caps are satisfactory for the function for which they are designed, and guarantee impregnability of the closure.

However, caps of this first category present a problem for recycling the raw material of the empty containers. As a general rule, it may be assumed that the containers are made of glass or plastics material. On the other hand, the closure caps are mainly made of polypropylene or polyethylene. The caps of the above type therefore leave on the neck of the container a ring of a different material from that of the container. During the recycling operations, it is therefore necessary to sort and separate the two materials present, which presents the problem of the technical means to be employed and of the extra cost added to the recycling process due to the presence of such rings.

The closure caps of moulded plastics material of the second category comprise a tamper-proof ring which must be voluntarily broken and partly detached by the user him/herself.

Such tamper-proof rings are generally of the "pigtail" type, so-called due to the pseudo-helicoidal spiralled shape on the partly trimmed tamper-proof ring which generally remains attached to the skirt of the cap by a connection foot.

The closure caps of this second category achieve the first object of indicating a of violation and solve the subsequent problem of separation, prior to recycling, because the tamper-proof rings remain connected to the caps and are no longer immobilized in the form of belt or ring around the neck of the container.

Although the closure caps of this second category are satisfactory in these two respects, they still raise a problem of manufacture for the following reasons.

The closure caps of the second category may be produced in two ways.

The first consists in moulding on the inner face of the skirt profiles in overthickness of direction parallel to the axis, then in a subsequent take-up operation, forming the transverse plane of rupture between the skirt and the tamper-proof ring, by means of an incision by a cutting blade cutting the whole thickness of the peripheral wall and consequently leaving profiles in internal overthickness.

In this way, the profiles in overthickness constitute cleavable bridges when a force is imposed thereon upon opening via an inner folded band abutting beneath a counter-ring of the neck of the container.

However, for such a tamper-proof ring to be able to perform its function, as provided previously, it is also necessary to arrange in some way or other in the tamper-proof ring and below the transverse plane of rupture, a zone of least resistance on which the user may act voluntarily to provoke the axial opening allowing the ring to be trimmed.

However, such a requirement is not sufficient since, as a general rule, it is also necessary to leave between the ring and the skirt and in the transverse plane of rupture, a non-cutout zone leaving a connection foot to maintain the band cutout, in that case qualified as "pigtail", attached to the cap during the manipulations of opening and reclosing the neck.

The known prior art may be illustrated by Application WO91/17090 and, in particular, by FIGS. 2, 3 and 5 thereof.

As a general rule, these two requirements are satisfied by making, by incision, the transverse cutting plane by means of a knife, of the circular type, presenting in its cutting edge a setback to leave the necessary non-incised part, such a knife comprising, adjacent the setback and in a plane perpendicular to its plane, a rigid blade intended to form the zone of least resistance in the band.

In fact, the above means can only be suitably employed insofar as the intervention of the rigid blade coincides with an interruption of the band folded inwardly and belonging to the tamper-proof belt.

In fact, in the absence of such a coincidence, rupture of the tamper-proof ring becomes impossible.

This is why, during manufacture of such caps, it is necessary to perform, prior to the action of the circular knife, an alignment operation to place the plane of intervention of the blade in alignment or register with that of the interruption of the inner band.

Although this requirement is not insurmountable, it complicates the take-up operation and substantially reduces the production rates for the final cap shaping operation.

The second method of obtaining such caps consists in moulding in the tamper-proof ring a zone of least resistance and in producing or forming the transverse plane of rupture by an incision by means of a circular knife whose cutting edge comprises notches in places to leave cleavable bridges. Such is typically the case of Application WO91/17090.

Such a method is not without interest but it also requires employing a circular knife presenting a setback intended to leave in the transverse plane a non-weakened part in order to form a permanent connection foot between the, "pigtail" band and the skirt.

Consequently, it is also necessary to proceed, prior to the action of the knife, with a relative alignment so that the setback of the blade leaves the non-cutout part of the thickness of the skirt, adjacent to the zone of least resistance Although the second process is somewhat different from the first, the effect is the same and, as before, it does not enable closure caps to be produced at a very high rate or at least at a rate which is in exact proportion to that of the injection moulding machines.

Furthermore, it is observed fairly frequently that either the opening of the band is produced on the whole turn or this opening is not produced suitably. This is due to the fact that the resistance that the connection foot must offer is inadequate.

SUMMARY OF THE INVENTION

It is an object of the present invention to overcome the problems thus raised by proposing a novel closure cap of moulded plastics material which may be obtained by employing the same successive operations of injection moulding and incision, but without requiring the prior alignment of each cap relative to the cutting member.

To obtain the above result, the closure cap of moulded plastics material of the invention, for closing a necked container, comprises a top, a cylindrical skirt provided internally with one or more helicoidal threads for screwing on the complementary part of the neck, a tamper-proof ring detachable by rupture along a plane transverse with respect to the axis of symmetry of the cap and formed by an annular belt extending the skirt at its base and by a band comprising at least one interruption and folded inwardly from the lower edge of the belt, in manner inclined towards the top, in order to be able to cooperate with and abut, after screwing, beneath a counter-ring presented by the neck, said annular belt comprising, moulded therewith:

at least one zone of least resistance extending in a direction substantially parallel to the axis of symmetry of the cap, over the height of the belt included between its lower edge and the transverse plane of rapture, and a local overthickness formed from the inner peripheral surface to extend on either side of the transverse plane of rupture, being adjacent, by one of its edges, to a radial plane passing through the zone of least resistance, wherein the belt comprises a local overthickness presenting an angular area corresponding to that separating two successive interruptions of the folded band.

BRIEF DESCRIPTION OF THE FIGURES OF DRAWING

The invention will be more readily understood on reading the following description with reference to the accompanying drawings, in which.

Figure 1:
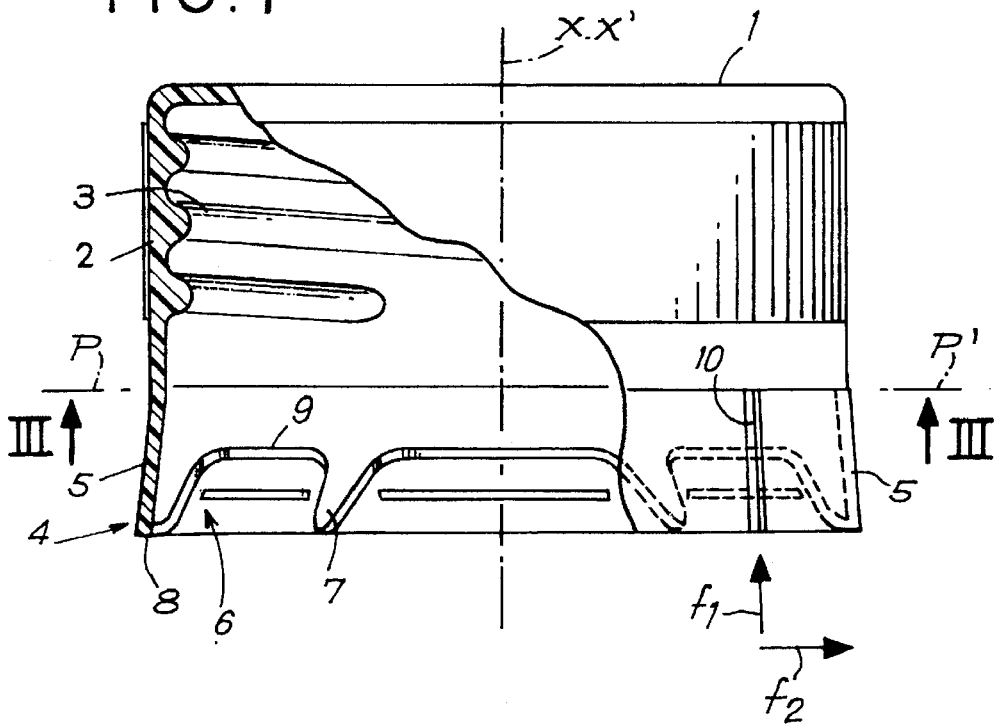
FIG. 1 is a view in elevation, partly in section and torn away, of a closure cap according to the invention.
Figure 2:
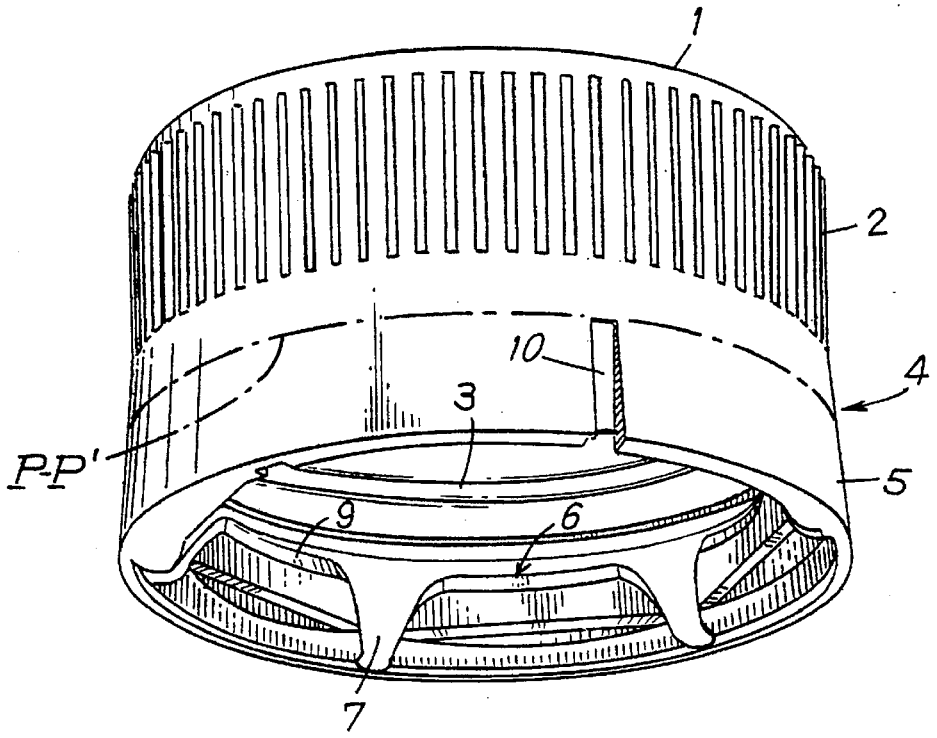
FIG. 2 is a view in perspective showing certain characteristics of the cap according to the invention.

Referring now to the drawings, FIGS. 1 and 2 show a closure cap made of moulded plastics material comprising a top 1, a cylindrical skirt 2 internally provided with one or more helicoidal threads 3 intended to allow the cap to be screwed on the complementary part of the neck of a container, of the bottle type, not shown.

The closure cap comprises, from the base of the cylindrical skirt 2, a tamper-proof ring 4 which is detachable by rupture along a plane P-P' transverse with respect to the longitudinal axis of symmetry x-x' of the cap and schematically shown in dashed and dotted lines. The tamper-proof ring 4 is formed, in known manner, by a belt 5 which extends the base of the skirt 2, presenting a likewise substantially cylindrical shape. Furthermore, the ring 4 comprises a band 6 presenting interruptions 7 and which is folded inwardly from the lower edge 8 of the belt 5, in manner inclined towards the top 1, in order to be able to cooperate, as is known in the art, after the cap has been screwed on the neck, with the lower part of a counter-ring which the latter presents. The band 6 is thus constituted by a plurality of petals 9 defined by the interruptions.

Figure 3:
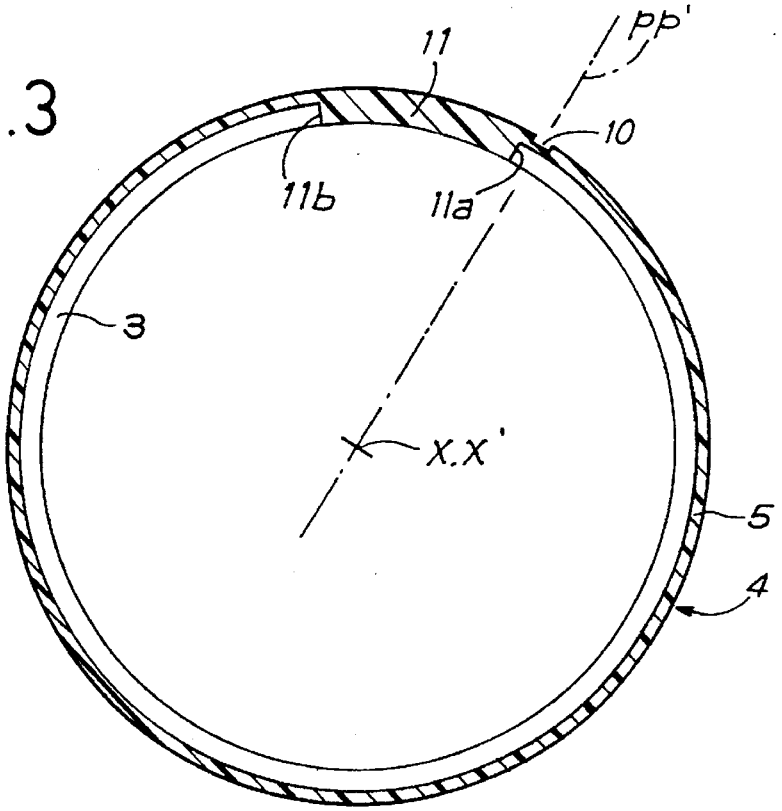
FIG. 3 is a transverse section taken along line III—III of FIG. 1.

According to the invention illustrated in FIGS. 3 and 4, the closure cap described hereinabove is made by moulding, so as to comprise, moulded therein, at least one zone of least resistance 10 extending in a direction substantially parallel to the axis of symmetry x-x', over the height of the belt 5 included between its lower edge 8 and the plane P-P' (FIG. 2). The zone of least resistance 10 may be obtained in any appropriate manner, being constituted for example by a hollow or a groove made in the inner, or preferably outer peripheral face, as illustrated in FIGS. 2 and 3.

In all cases, the zone of least resistance 10 is made to be visually perceptible from the outer face of the belt 5, for reasons of identification during use.

According to another constructive arrangement, illustrated in the same figures, moulding of the closure cap also includes providing the tamper-proof ring 4 with a local overthickness 11 which is formed from the inner peripheral surface of the annular belt 5, to extend on either side of the transverse plane of rupture P-P', being substantially adjacent, by one of its edges such as edge 11*a*, to a radial plane p—p' passing through the zone of least resistance 10. (See FIG. 3.) The overthickness 11 presents an angular area corresponding to that separating two successive interruptions 7 of the folded band.

Although this has not been shown, it may of course be envisaged to make the local overthickness 11 so that it is adjacent plane p—p' by its second edge such as 11*b*.

Figure 5:
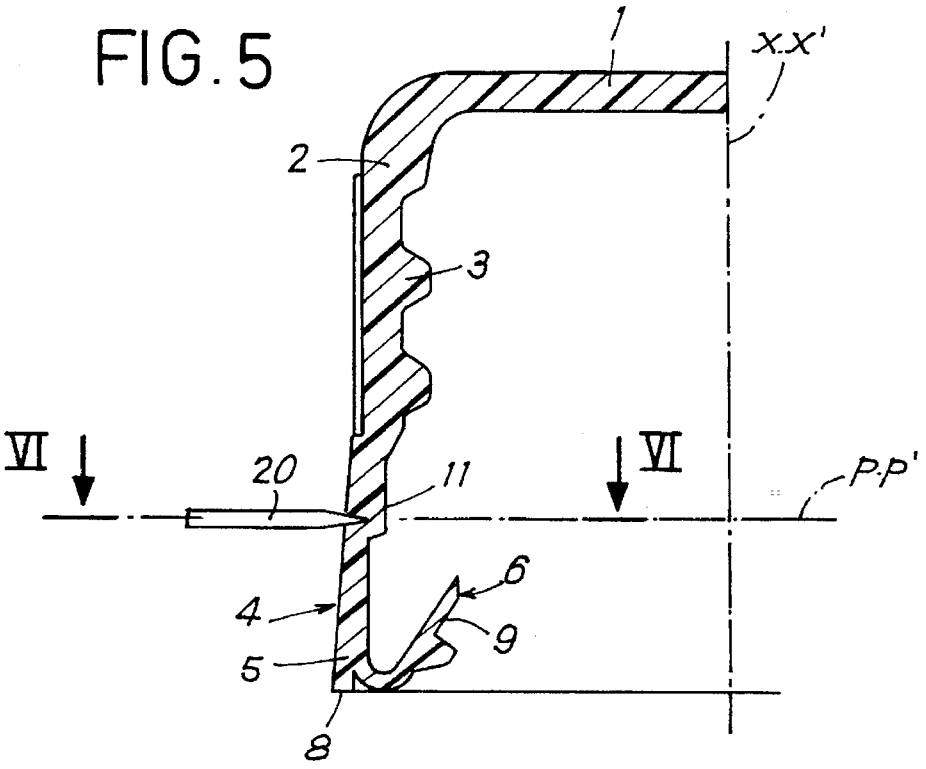
FIG. 5 is a partial section-elevation illustrating a step in the manufacture of the cap.
Figure 6:
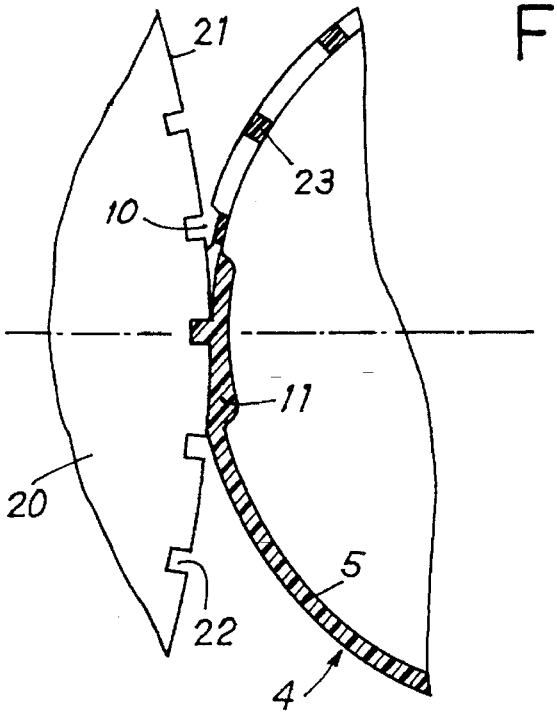
FIG. 6 is a partial transverse section taken along line VI—VI of FIG. 5.

The closure cap obtained with the above characteristics is then incised via a knife 20, of circular type, as illustrated in FIGS. 5 and 6 and presenting in its cutting edge 21 notches 22 arranged in places.

The action of the knife 20 intervenes from the outer peripheral surface in plane P-P', so as to incise the thickness of the skirt and of the belt 5 over the whole thickness, leaving in this plane and due to the presence of the notches 22, connecting bridges 23 which are cleavable and which define, at the same time as the incision made, the future plane of separation between the base of the skirt 2 and the belt 5 of the tamper-proof ring 4.

Although the action of the incision knife is provided to incise the whole thickness of the wall, it is understood that this action does not cause the knife to penetrate the local overthickness 11 which therefore maintains its initial thickness on the angular part that it covers, maintaining a connection of thickness between the belt 5 and the skirt 2.

In this way, when after assembly on the neck of a container it is desired to open the capsule, the user acts on the belt 5 level with the zone of least resistance 10 to open by tearing of this zone. He/she acts for example in the direction of arrow $f_1$ (FIG. 1), then applying an action in the direction of arrow $f_2$ (FIG. 1) and proceeds with trimming the ring, in anti-clockwise direction in respect of the drawings, so as to successively rupture the cleavable bridges 23 in plane P-P' and to detach the belt 5 with respect to the base of the skirt 2.

The ring may thus be trimmed from the edge 11*a* of the local overthickness 11 and over the whole periphery until edge 11*b* is then attained. In this manner, the trimmed ring remains attached to the skirt by the local part corresponding to the overthickness 11 which constitutes a connection foot, firmly maintaining the trimmed tamper-proof ring in the form of a pig-tail and attached to the skirt 2.

It must be understood that the embodiment according to the invention does not eliminate the function of impregnability which remains efficient when an untimely opening is attempted by unscrewing the capsule.

In fact, in such a case, the inwardly folded band 6 cooperates with the counter-ring which constitutes a stop opposing axial displacement of the ring 4 and then provoking rupture of the cleavable bridges 23.

Plane P-P' may be formed without relative alignment given that, by moulding and by construction, the local overthickness 11 is provided adjacent by one of its edges to the zone of least resistance 10.

Figure 4:
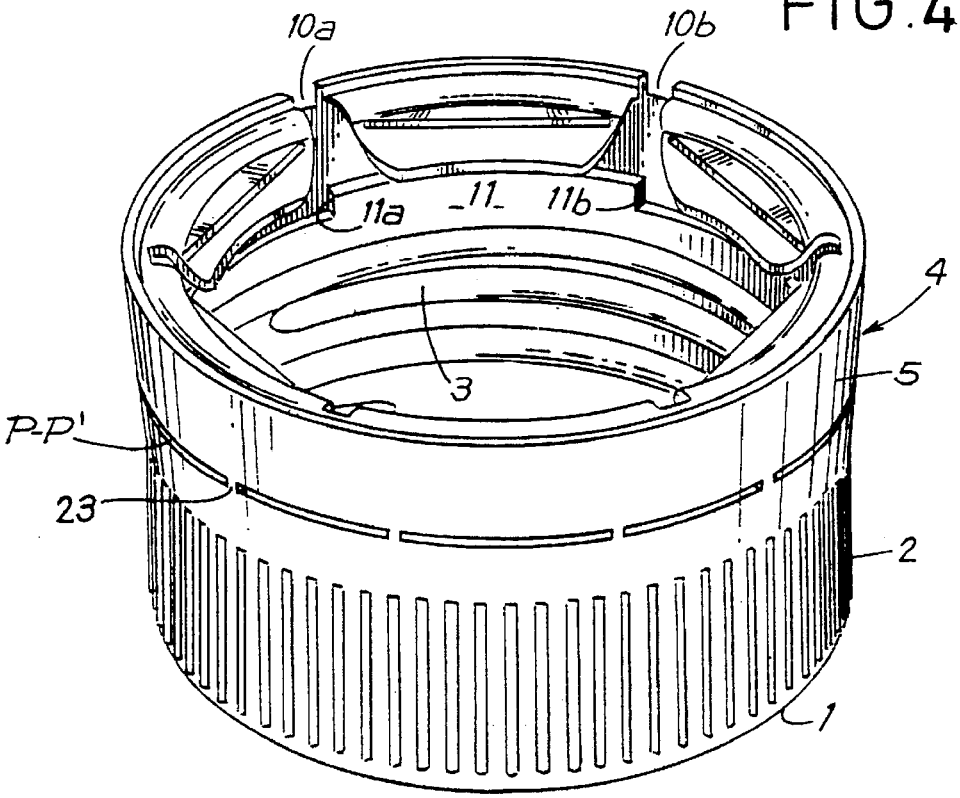
FIG. 4 is a perspective view illustrating the cap according to the invention.

FIG. 4 shows that it is also possible to provide in band 5 two zones of least resistance 10*a* and 10*b* adjacent the edges 11*a* and 11*b* of the overthickness 11. In this way, it becomes possible to proceed with trimming the tamper-proof ring, ensuring separation of the latter on either side of the local overthickness 11.

The closure caps according to the invention eliminates compulsory alignment to effect incision and facilitates opening of the cap because the band 6 is easier to tear as it occurs from an overthickness 11 which is highly resistant by its position and its angular area.

Furthermore, the advantage offered by the embodiment with double zone 10 follows from the fact that trimming may be equally well accomplished by a left- or right-handed operator.

The invention is not limited to the examples described and shown, as various modifications may be made thereto without departing from its scope.

What is claimed is:

1. Closure cap of moulded plastics material for closing a necked container comprising a top, a cylindrical skirt provided internally with one or more helicoidal threads for screwing on a complementary part of the neck of a necked container, a tamper-proof ring detachable by rupture along a plane transverse with respect to the longitudinal axis of symmetry of the cap and formed by an annular belt extending the skirt at its base and by a band folded inwardly from the lower edge of the belt and inclined towards the top, in order to cooperate with and abut, beneath a counter-ring presented by the neck, said folded band having at least two interruptions, said annular belt comprising, moulded therein, at least one zone of least resistance extending in a direction substantially parallel to the longitudinal axis of symmetry of the cap, over the height of the belt included between the lower edge of the belt and the transverse plane of rupture and a local overthickness formed along an inner peripheral surface of the belt and extending on either side of the transverse plane of rupture, said local overthickness being disposed between two successive interruptions of the folded band and having an edge adjacent to a radial plane passing through the zone of least resistance.

2. The cap of claim 1, wherein the belt comprises two zones of least resistance.

3. The cap of claim 1, wherein the belt comprises two zones of least resistance which are formed along two radial planes passing through the edges of the overthickness.

4. The cap of claim 1, wherein the belt is joined to the base of the skirt by cleavable bridges formed by incision along the transverse plane of rupture in an outer periphery of the ring and skirt by means of a notched circular cutting member.

* * * * *